United States Patent [19]

Theno

[11] Patent Number: 5,016,373

[45] Date of Patent: May 21, 1991

[54] COLLAGE SHEET HAVING ROLLABLE RELEASABLE ADHESIVE SURFACE

[76] Inventor: Mark H. Theno, 3206 Second Ave. East, Hibbing, Minn. 55746

[21] Appl. No.: 611,461

[22] Filed: Nov. 6, 1990

Related U.S. Application Data

[63] Continuation of Ser. No. 245,509, Sep. 19, 1988, abandoned.

[51] Int. Cl.[5] ..... G09F 7/12

[52] U.S. Cl. ..... 40/594; 40/617; 428/7; 206/575

[58] Field of Search ..... 40/594, 595, 519, 617, 40/124.1, 124; 206/575, 459; 428/7, 8

[56] References Cited

U.S. PATENT DOCUMENTS

| | | | |
|---|---|---|---|
| 388,041 | 8/1888 | Higgins | 40/514 |
| 1,107,585 | 8/1914 | Burnam | 40/617 |
| 1,479,423 | 1/1924 | Barton | 40/124 |
| 1,624,741 | 4/1927 | Leppke et al. . | |
| 1,676,835 | 7/1928 | Oberheu . | |
| 1,677,919 | 7/1928 | Hansen . | |
| 2,046,924 | 7/1936 | Pendergast . | |
| 2,586,039 | 2/1952 | Heggedal . | |
| 2,775,048 | 12/1956 | Berman . | |
| 2,914,873 | 12/1959 | Brennan . | |
| 3,241,662 | 6/1922 | Robinson et al. | 428/343 |
| 3,368,295 | 2/1968 | Burns et al. | 40/657 |
| 3,671,004 | 6/1972 | Cram . | |
| 3,734,816 | 5/1973 | Swasey . | |
| 3,797,150 | 3/1974 | Hinckley | 40/617 X |
| 3,952,133 | 4/1976 | Amos et al. | 427/208 |
| 4,301,205 | 11/1981 | Seltenheim | 40/594 |
| 4,679,822 | 7/1987 | Wolfe | 40/514 |
| 4,791,790 | 12/1988 | Ferrari | 428/7 |

FOREIGN PATENT DOCUMENTS

| | | | |
|---|---|---|---|
| 1809794 | 7/1969 | Fed. Rep. of Germany | 40/594 |
| 2549266 | 1/1985 | France | 40/594 |
| 842480 | 7/1960 | United Kingdom | 40/621 |

*Primary Examiner*—Peter R. Brown
*Assistant Examiner*—James M. Gardner
*Attorney, Agent, or Firm*—Jacobson & Johnson

[57] ABSTRACT

A collage sheet for hanging on the wall and securing articles thereto comprising a sheet of material having an adhesive on one side with said sheet of material wound around a cylindrical support so that said sheet of material can be unwound to form a collage sheet with an exposed adhesive surface that articles can be fastened thereto and a member for supporting the collage sheet on a wall with the sheet of material having a rib and a weight for holding the portion of the unrolled collage sheet in a flat condition.

7 Claims, 1 Drawing Sheet

COLLAGE SHEET HAVING ROLLABLE RELEASABLE ADHESIVE SURFACE

This application is a continuation of application number 245,509, filed 9/19/88, now abandoned.

BACKGROUND OF THE INVENTION

1. Field of the Invention

This invention generally relates to collage sheets and, more specifically, to a reusable collage sheet that can be unrolled to hold and display greeting cards or other slogans in an attractive manner where they are readily visible to a person.

2. Description of the Prior Art

The concept of display structures or devices for holding paper or signs is old in the art. Typically, the prior art devices have some type of surface where a slogan or paper can be attached to.

The 1927 Leppke U.S. Pat. No. 1,624,741 shows a display device with a metal backing board that can receive and hold magnetized articles that have letters or pictures of items secured to the magnetized article.

The 1928 Oberheu U.S. Pat. No. 1,676,835 shows a sign supporting device with members that have adhesives on to support and hold a sign in place by permitting the user to fasten the member to both the window and the sign.

The 1928 Hansen U.S. patent shows an interchangeable sign or bulletin board that holds articles on the surface through magnetized materials.

The 1936 Pendergast U.S. Pat. No. 2,046,924 shows an article or display sign coated with an adhesive for attachment to windows or the like.

The 1952 Heggedal U.S. Pat. No. 2,586,039 shows a display board for photos or the like in which the adhesion between the two objects is obtained by a sheet of flat, flexible vinyl chloride which is pressed against a glass to permit the material to self-adhere to the glass through the coaction of the glass and the flexible sheet of vinyl chloride.

The 1956 Berman U.S. patent shows a visual display device having a board with strips of adhesive film that are not readily visible from a substantial distance from the panel but are visible from close up. Display characters can be attached to the tape to create a display.

The 1959 Brennan U.S. Pat. No. 2,914,873 shows a backing board having a pebbled surface of an adhesive that can be used to mount articles on the board.

The 1972 Cram U.S. Pat. No. 3,671,004 shows a hanger for a lightweight sheet of relatively stiff colored material that is hung from a wire hanger made of a U-shaped channel that fits over the ends of the sheet of material. The channels prevent the sheets from curling up when the the hanger is located on a wall.

The 1973 Swasey U.S. Pat. No. 3,734,816 shows a laminated display board having a renewable tack surface for hanging article thereon.

BRIEF SUMMARY OF THE INVENTION

Briefly, the present invention comprises a collage sheet that can be unrolled to the desired length to hold and display items such as signs or greeting cards. The collage sheet includes a decorative sheet of material wound on a support tube with an adhesive on one side of the sheet to fasten articles thereto. The tube permits the material to be wound or unwound to the proper length as well as acting as a stiffener for the top portion of the collage sheet. A lower support member holds the lower edge of the material to keep the collage sheet from curling. If a portion of the collage sheet should become soiled the user merely cuts off the soiled end and reinserts the bottom support member on the material to provide a fresh looking collage sheet.

DESCRIPTION OF THE PREFERRED EMBODIMENT

Figure 1:
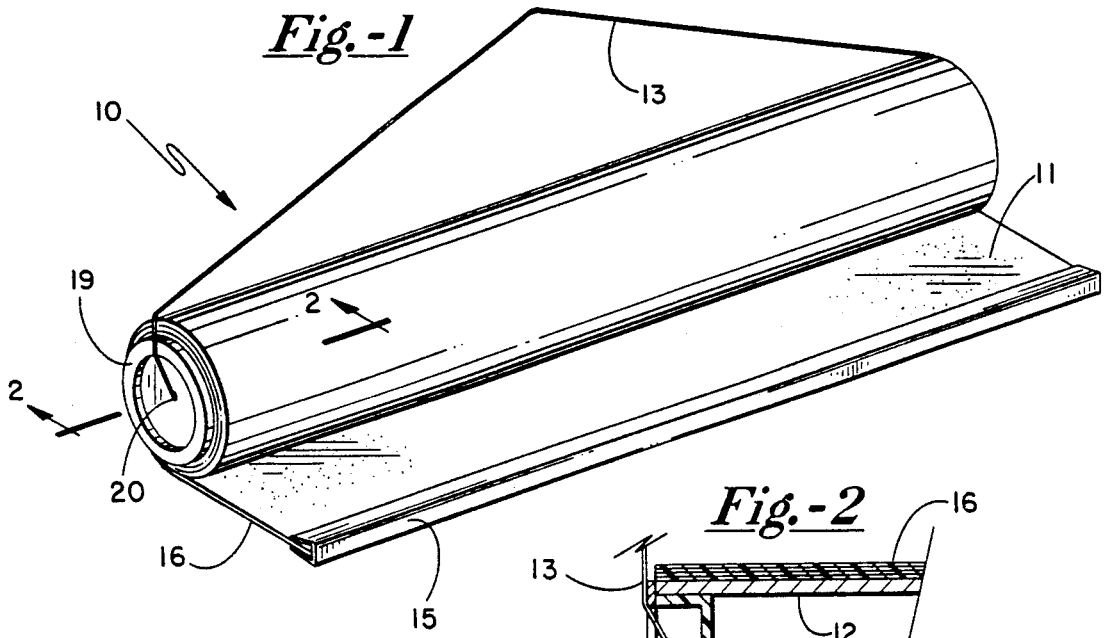
FIG. 1 shows a pictorial view of my invention in a partially rolled up condition.

Referring to FIG. 1 reference numeral 10 identifies my hanging collage sheet with an adjustable hanging surface 11 for temporarily attaching signs or greeting cards thereto. Located on one surface of rolled sheet 16 is a transparent pressure sensitive adhesive 11 and on the back surface is a layer of release material 23 that permits the collage sheet to be rerolled after use. Located on each end of collage sheet 10 is an end cap 19 that forms a friction fit in a hollow cylindrical support core 12. A string 13 for hanging collage sheet 10 on a wall extends through the material support cylinder 12 and through the end caps 19 located on the ends of support cylinder 12. Support cylinder 12 is preferably made of a light material such as polymer plastic or a stiff cardboard that will retain its cylindrical shape when hung on a wall.

Collage sheet 10 cam be made of any number of different colored material so that the collage sheet 10 has its own decorative appearance which is framed by the rolled material at the top of the collage sheet and a rib 15 located at the bottom of collage sheet 10.

Figure 4:
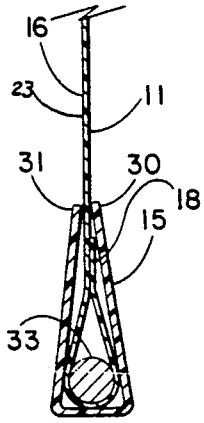
FIG. 4 shows a cutaway view of the lower portion of my collage sheet.

FIG. 4 illustrates how rib 15 engages sheet 16 at rib edges 30 and 31. Since rib 15 is made from a rigid yet flexible material the user can pry edges 30 and 31 apart to remove rib 15. Located in the folded over end of sheet 16 and at the bottom of rib 15 is a cylindrical metal rod 33 that extends lengthwise through rib 15 to provide weight to hold sheet 16 from curling upward after it is unrolled from cylinder 12. Rod 33 is sandwiched on the adhesive side of sheet 16 so that adhesive 11 holds rod 33 from slipping out of rib 15. In the embodiment shown material 16 wraps around rod 33 and back on itself at region 18 to securely fasten rod 33 to sheet 16. The coaction of the rod 33 wrapped in material 16 with rib 15 coacts to also form a mechanical interlock that aids in retention of rib 15 on the end of sheet 16.

The advantage of my weighted remountable rib is that it ensures that the material 16 hangs vertically downward while providing a decorative rib 15 at the lower end of sheet 16. Rib 15 comprises a rigid but flexible polymer plastic material that has upward extending edges 30 and 31 that normally bear inward toward each other to provide a clear natural-appearing clamping action against sheet 16.

Figure 2:
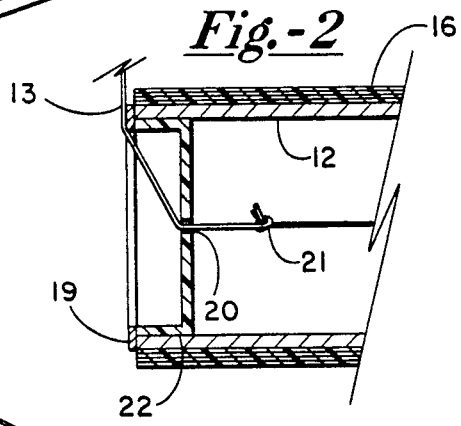
FIG. 2 shows a sectional view of an end cap and a portion of the take up roll.

FIG. 2 shows a partial sectional view of collage sheet 10 showing how end cap 19 forms a friction fit with the interior surface of cylindrical support 12. A lip on the outer edge of the end cap 19 extends over the end of cylindrical support cylinder to maintain the end cap in perpendicular relation to support cylinder 12. Located in each of end caps 19 is a centrally located hole 20 that has a diameter that is slightly larger than the support string 13. In operation of my collage sheet string 13 extends through the end caps 19 located on the opposite ends of cylinder 12. To form string into a loop for holding the collage sheet a knot 21 is formed in the ends of string 20. By locating the knot 21 in the interior of cylinder 12 the small holes 20 in end caps 19 prevents the unsightly knot 21 from sliding through the opening end caps and spoiling the visual appearance of my collage sheet.

Figure 3:
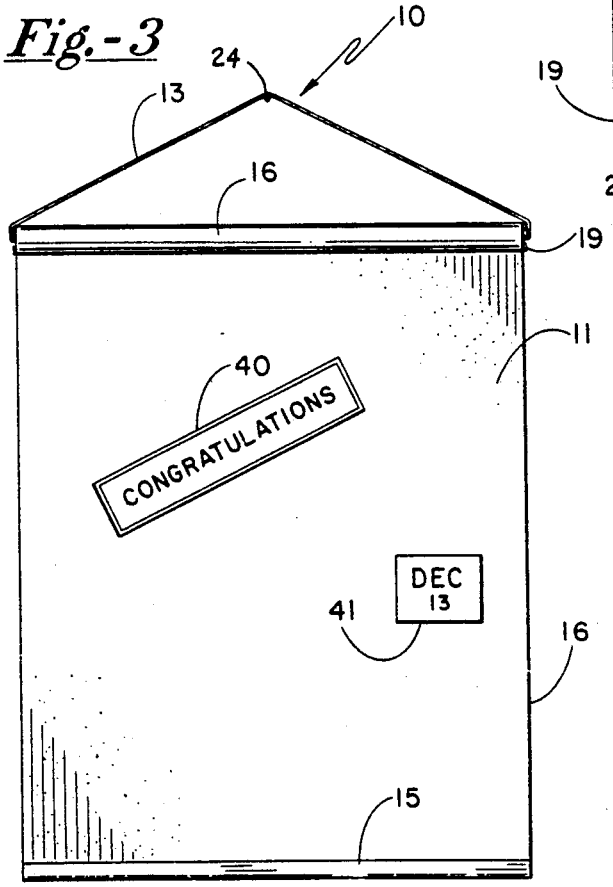
FIG. 3 shows my collage sheet hanging on a wall.

FIG. 3 illustrates how my invention may be used by hanging collage sheet on a nail 24 located on a wall. To use my invention the user unrolls sheet 16 to the desired length and then places the signs 40 or 41 on the adhesive layer 11. Signs 40 and 41 are illustrative of the types of signs that could be used, other signs that could be used are HAPPY BIRTHDAY or GET WELL. Since the adhesive 11 will hold lightweight objects such as cards or the like the user can create his/her own signs to place on collage sheet 10.

One of the advantages of my collage sheet 10 is that the collage sheet which typically is about 12 inches wide can be unrolled to any desired length by the user. In addition, if the exposed area where signs are attached should become soiled from use the user can cut off the exposed portion and unroll a fresh piece of material from collage sheet 10. The user can remove rib 15 and metal weight 33 from the cut off section of sheet 16 and install them on the fresh portion of sheet 16 since metal weight 33 and rib 15 do not require any special tools for fastening to sheet 16.

The use of adhesive on sheet 16 and the combination of support at the end caps is sufficient to prevent unwinding of the sheet 16 due to the weight of the articles placed on my collage sheet. I have found that for porous decorative sheet material 16 made of polypropylene or rayon acetate, the use of a pressure sensitive adhesive 11 on one side of material 16 and a backing release agent such as a silicone, urethane, flurocarbon, acrylic emulsion or polyolefin materials located on the opposite surface of material 16 are particularly useful to produce a rerollable and reusable collage sheet. The release agent, which is prepared in a highly viscous liquid form, is coated directly on one surface of the material. Since the material's porosity is very small and the release agent is viscous, the release agent does not immediately penetrate the material. Once the release agent is coated on the top surface of the material, the release agent is cured before the release agent has sufficient time to flow into the porous material. The insitu curing of the release agent forms a transparent polymerized solid flexible film that tenaciously adheres to the top surface of the material but permits the rerolling and reusing of my collage sheet. A particularly useful insitu curing involves using electron beam curing by impacting the polymer release agent with high energy electrons to quickly cure the release agent into a thin flexibly polymerized transparent film. The polymerized transparent film prevents further flow or creep of the release agent during extended periods of non-use of the collage sheet. Consequently, even though the pressure-sensitive adhesive may flow, the adhesive cannot penetrate the film because of the release agent. Thus, one is insured that the roll of material will maintain its integrity and can be unwound and used at the next event.

I have found that any number of adhesives, such as acrylic, hot melt, water-based or solid-based adhesives may be used in the invention, as long as they are compatible with the release agent and the ribbon. However, I prefer to use a pressure-sensitive hot melt adhesive which has 180 degree peel strength of about 26 pounds per square inch or less. This type of adhesive is generally referred to in the art as being a repositionable adhesive and works well for attaching articles such as signs or cards to collage sheet 10.

It will be appreciated that one of the advantages of my invention is that collage sheet 16 can be cut with a conventional household scissors to permit a soiled portion of the collage sheet to be removed. Rib 15 and rod 33 can be removed from the cut section and reused.

I claim:

1. A kit to permit a user to temporarily fastening greeting cards or like planar objects thereto comprising:

a collage sheet of decorative flexible material having a first surface and a second surface with said first surface having a pressure sensitive adhesive thereon to permit a user to temporarily attach an article thereto, said sheet of decorative flexible material having a first end;

a hollow cylindrical support for winding said decorative flexible material thereon, said sheet of decorative material wound on said hollow cylindrical support to provide a roll of decorative flexible material that is adhesively secured to itself and can be unwound from said roll of flexible material to allow said article to be attachable to an unwound portion of said sheet of decorative flexible material;

a rib attached to said first end of said decorative flexible material to hold said decorative flexible material in a flat condition, said rib comprising a triangular shape with a pair of edges that normally resiliently engage each other to grip an object therebetween, said edges forming engagement with said first surface and said second surface of said sheet to thereby grip said sheet;

a weight for holding said sheet in a flat condition with said weight being secured to the first end of said sheet by the adhesive surface of said sheet extending into contact with said weight to thereby prevent disengagement of said weight from said sheet; and a greeting card or like planar object for attaching to said pressure sensitive adhesive to permit a user to temporarily form said decorative material and said greeting card or the like into a decorative wall collage.

2. The apparatus of claim 1 including a string extending through said cylindrical support to hold said collage sheet in a vertical position on a wall.

3. The apparatus of claim 2 wherein said sheet is at least 12 inches wide.

4. The apparatus of claim 1 including decorative signs attached to said adhesive surface on said decorative flexible material.

5. The apparatus of claim 1 wherein said decorative flexible material is made of a material that can be cut off with a household scissors to permit a user to cut off a portion of said decorative flexible material that has become soiled or unusable and to unroll additional decorative flexible material from said cylindrical support to renew said collage sheet for securing articles thereto.

6. A hanging collage sheet for temporarily holding greeting cards or like planar object thereon to form a collage for hanging on a wall to display greeting cards and the like in a visually appealing manner comprising:

a sheet of decorative flexible material, said decorative flexible material comprising a decorative material free of advertising, said decorative flexible material having a first end, a first surface, a back surface, and a pressure sensitive fastening material located on said first surface, said pressure sensitive material adhering to said sheet of decorative material and to articles that are to be temporarily attached to said sheet of decorative flexible material to thereby permit a user to temporarily attach greeting cards or like planar objects to said first surface by applying pressure to the article after the greeting cards or like planar objects is placed against said pressure sensitive fastening material on said first surface;

a cylindrical support roll, said sheet of decorative flexible material wound around said cylindrical support roll to thereby permit a user to unwind a portion of said sheet of decorative flexible material so that greeting cards or like planar objects can be fastened to the unwound portion of said sheet of decorative flexible material in an attractive manner by the pressure sensitive material located on said first surface;

means for hanging said cylindrical support roll on a wall so that the unwound portion of said sheet hangs vertically downward to permit a user to attach greeting cards or like planar objects thereto; and a weighted rib attached to said first end of said decorative flexible material to hold the unwound portion of said decorative flexible material in a flat condition when said decorative flexible material is suspended vertically from said means for hanging said cylindrical support roll, said weighted rib including a pair of edges that normally resiliently engage each other to grip an object therebetween, said edges forming engagement with said first surface and said back surface of said sheet of decorative flexible material to thereby grip said sheet so that the unwound portion of said sheet hangs vertically downward so that a user can attach greeting cards or like planar objects to said sheet of material in an attractive manner.

7. The collage sheet of claim 6 wherein said pressure sensitive fastening material comprises a reuseable pressure sensitive adhesive.

* * * * *